US011035191B2

(12) United States Patent
Wernø et al.

(10) Patent No.: US 11,035,191 B2
(45) Date of Patent: Jun. 15, 2021

(54) SUBSEA WELLHEAD MONITORING AND CONTROLLING

(71) Applicant: EQUINOR ENERGY AS, Stavanger (NO)

(72) Inventors: Tore Geir Wernø, Sandnes (NO); Lorents Reinås, Stavanger (NO); Harald Sigurd Nesse, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/471,906

(22) PCT Filed: Dec. 22, 2017

(86) PCT No.: PCT/NO2017/050388
§ 371 (c)(1),
(2) Date: Jun. 20, 2019

(87) PCT Pub. No.: WO2018/117860
PCT Pub. Date: Jun. 28, 2018

(65) Prior Publication Data

US 2020/0102802 A1 Apr. 2, 2020

(30) Foreign Application Priority Data

Dec. 23, 2016 (GB) ..... 1622122

(51) Int. Cl.
*E21B 33/035* (2006.01)
*E21B 33/043* (2006.01)
(Continued)

(52) U.S. Cl.
CPC ..... *E21B 33/0355* (2013.01); *E21B 33/043* (2013.01); *E21B 33/076* (2013.01); *E21B 34/04* (2013.01)

(58) Field of Classification Search
CPC .. E21B 33/0355; E21B 33/043; E21B 33/076; E21B 33/04
See application file for complete search history.

(56) References Cited

U.S. PATENT DOCUMENTS 4,476,936 A * 10/1984 Boyadjieff ..... E21B 19/00 166/383
5,366,017 A 11/1994 Voss, Jr.
(Continued)

FOREIGN PATENT DOCUMENTS

| | | |
|---|---|---|
| EP | 1 233 145 | 8/2002 |
| GB | 2 358 204 | 7/2001 |
| WO | 00/47864 | 8/2000 |

OTHER PUBLICATIONS

International Search Report and Written Opinion of the International Searching Authority dated Mar. 13, 2018 in International (PCT) Application No. PCT/NO2017/050338.
(Continued)

*Primary Examiner* — Aaron L Lembo
(74) *Attorney, Agent, or Firm* — Wenderoth, Lind & Ponack, L.L.P.

(57) ABSTRACT

A subsea well assembly includes a high pressure wellhead housing; and a port for monitoring and/or controlling fluid within an annulus within the high pressure wellhead housing. The port extends through the high pressure wellhead housing. The subsea well assembly further includes a wellhead support for laterally supporting the high pressure wellhead housing, wherein, at an axial height of the port, the wellhead support surrounds the high pressure wellhead housing at circumferentially discrete locations and the port is located at a circumferential location where the high pressure wellhead housing is not covered by the wellhead
(Continued)

support. A method of monitoring and/or controlling fluid within the annulus within the subsea well assembly is also provided.

15 Claims, 1 Drawing Sheet

(51) Int. Cl.
*E21B 33/076* (2006.01)
*E21B 34/04* (2006.01)

(56) References Cited

U.S. PATENT DOCUMENTS 6,076,605 A 6/2000 Lilley et al.
6,692,194 B2 * 2/2004 Strand ..... E21B 41/0007 405/226
8,316,946 B2 * 11/2012 June ..... E21B 33/047 166/344
8,613,323 B2 * 12/2013 Garbett ..... E21B 33/038 166/368
9,051,824 B2 * 6/2015 Broussard ..... E21B 33/04
9,488,024 B2 * 11/2016 Hoffman ..... E21B 33/035
9,523,259 B2 * 12/2016 Christie ..... E21B 34/04
2002/0062965 A1 5/2002 Allen
2003/0111229 A1 6/2003 Clark
2003/0121667 A1 7/2003 Massie et al.
2003/0127229 A1 7/2003 Buckle et al.
2004/0238178 A1 12/2004 Laureano et al.
2012/0318518 A1 12/2012 Fenton

OTHER PUBLICATIONS

Search Report dated Mar. 7, 2017 in GB Application No. 1622122.8.

* cited by examiner

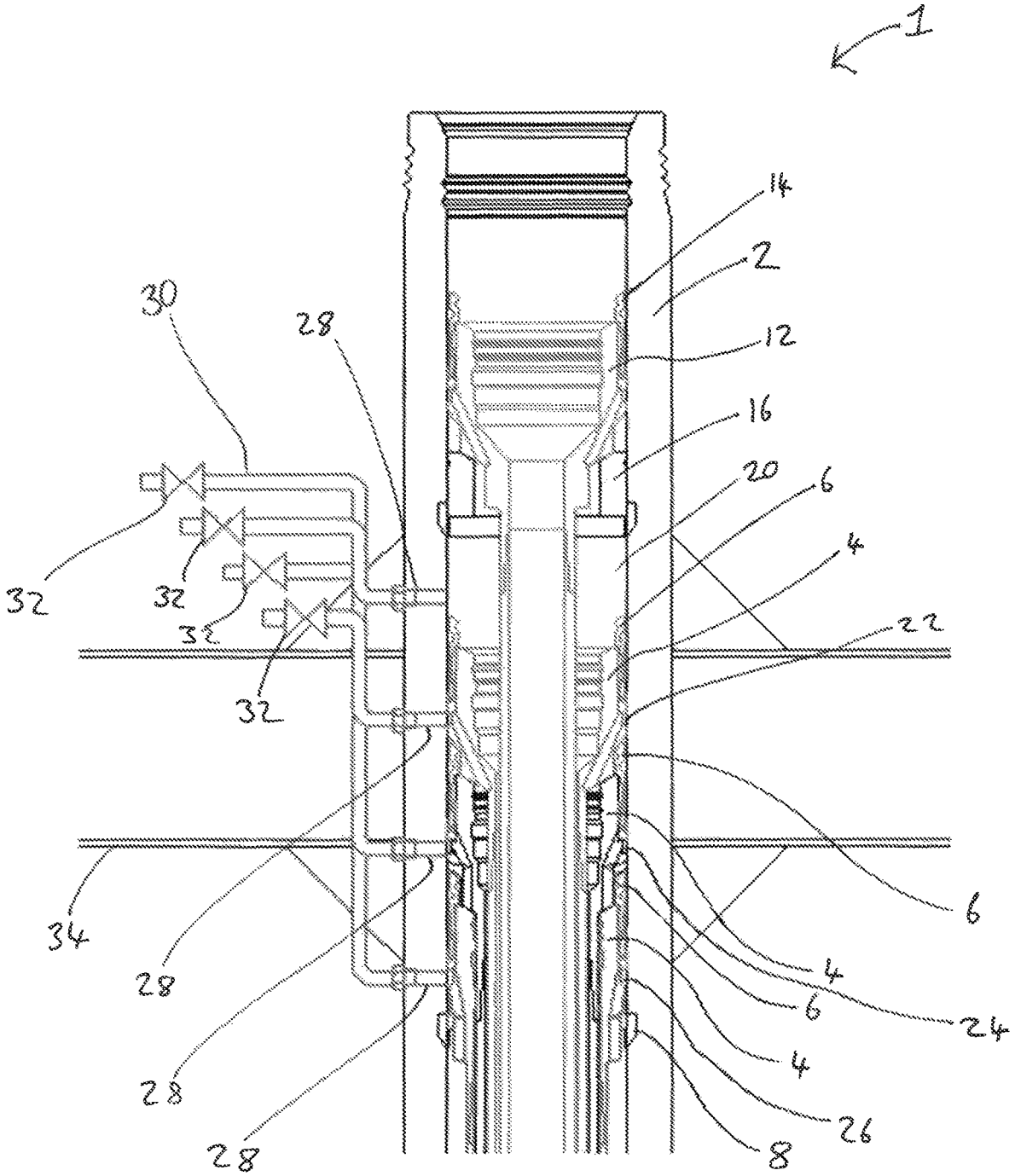
1
14
2
12
16
20
6
4
22
6
4
6
24
4
26
8
30
28
32
32
32
32
34
28
28
28

SUBSEA WELLHEAD MONITORING AND CONTROLLING

BACKGROUND OF THE INVENTION

1. Field of the Invention

The present invention is concerned with increasing the integrity of a subsea well assembly. In particular, the invention is concerned with monitoring and/or controlling fluids in a subsea well assembly.

2. Description of the Related Art

There is a requirement and increasing desire for the integrity of a subsea well to be maintained and improved. This may be done by monitoring and/or controlling the subsea well.

In subsea wellheads, currently, the pressure in the annular space between the production tubing and the first string of casing (i.e., production casing) is monitored. This pressure may be monitored via a pressure transducer located on a subsea tree on the wellhead. Managing this annulus pressure is often critical in order to ensure the integrity of the well. There is a desire to improve monitoring of the wellhead fluids so as to be able to improve the integrity of a subsea well.

SUMMARY OF THE INVENTION

In a first aspect, the present invention provides a subsea well assembly, the assembly comprising: a high pressure wellhead housing; a port (e.g., monitoring port), wherein the port extends through (e.g., through the wall of) the high pressure wellhead housing and is for monitoring and/or controlling a fluid within an annulus within the high pressure wellhead housing, and a wellhead support for laterally supporting the high pressure wellhead housing, wherein, at the axial height of the port, the wellhead support surrounds the high pressure wellhead housing at circumferentially discrete locations and the port is located at a circumferential location where the high pressure wellhead housing is not covered by the wellhead support.

The present invention may also provide a method of monitoring and/or controlling a fluid in an annulus of the high pressure wellhead housing of a subsea well assembly, the method comprising: providing a subsea well assembly comprising a high pressure wellhead housing and a port (e.g., monitoring or control port) that extends through the high pressure wellhead housing; and monitoring and/or controlling a fluid within an annulus within the high pressure wellhead housing. The subsea well assembly may be the subsea well assembly of the first aspect.

The monitoring and/or controlling of the fluid within the annulus may be done using the port (i.e., monitoring/control port) that extends through the high pressure wellhead housing. The method may comprise monitoring the fluid and optionally controlling the fluid based on the monitoring of the fluid.

The method may comprise using the assembly of the first aspect. This may include one or more or any combination of the following optional features. It has been realized that monitoring and/or controlling of fluids (e.g., monitoring and/or controlling the pressure, temperature or fluid characteristics, etc.) within a subsea wellhead assembly may be achieved by having one or more ports that extend through the high pressure wellhead housing.

The port may be referred to as a monitoring port and/or a control port. A port may be used for both monitoring and controlling the fluid within the high pressure wellhead housing.

Controlling the fluid may comprise bleeding and/or injecting fluids through the port. Thus, the port may be arranged to permit fluid flow therethrough (e.g., bleeding or injection). The fluid flow may only be permitted in one direction. This may be achieved by the introduction of a one way directional device connected to the port (e.g., a check valve). This one directional device may prohibit injection or bleeding (depending on the direction of the one directional device).

The assembly may comprise a plurality of ports for monitoring and/or controlling the fluid in a respective plurality of annuli. Each port may be for monitoring and/or controlling the fluid in a different annulus of the wellhead. Thus, the method may comprise monitoring and/or controlling the fluid in a plurality of annuli within the high pressure wellhead housing.

The plurality of ports may be at the same, or substantially the same, circumferential location around the high pressure wellhead housing.

The plurality of ports may each be at different axial height along the length of the high pressure wellhead housing.

One or more, or each annuli may be connected (i.e., fluidly connected) to a plurality of ports.

One or more, or each port may be connected (i.e., fluidly connected) to a plurality of annuli. This may for example be achieved by grooves or conduits in the high pressure wellhead housing and/or in the hangers or casings within the wellhead assembly.

The position of one or more or each annuli may change over time (for example, as components expand and contract due to thermal contraction). Therefore, the annulus or annuli that are fluidly to the port may change over time.

The annulus or annuli being monitored and/or controlled may be isolated from the other annuli in the high pressure wellhead housing. For example, each annulus being monitored and/or controlled may be isolated (i.e., fluidly isolated) from each of the other annuli being monitored and/or controlled. The annuli may be isolated from each other by means of a pack off assembly.

The annulus of well assembly may be any void between any piping, tubing or casing and the piping, tubing, or casing immediately surrounding it.

For example, the subsea well assembly may comprise a plurality of casings/casing hangers within the high pressure wellhead. The casing hangers may each seal to the high pressure wellhead housing to form a plurality of annuli.

The annulus may be a volume between two casing hangers in the subsea wellhead assembly. For example, it may be the annulus between a production casing hanger and an intermediate casing hanger, between two intermediate casing hangers and/or underneath a lowermost (i.e., closest to the reservoir) intermediate casing hanger.

At least part of the annulus may be located within the central bore/conduit of the high pressure wellhead housing.

The annulus may extend from the casing hanger down to the lower end of the casing suspended on that casing hanger.

The assembly may be arranged to permit monitoring and/or controlling of the pressure in one or more or all of the annuli in the wellhead, i.e., the high pressure wellhead housing.

One or more, or each port may extend through the wall (i.e., entirely through the wall) of the high pressure wellhead housing. For example, one or more, or each port may extend from an external surface of the high pressure wellhead housing to an internal surface of the high pressure wellhead housing, i.e., through the wall of the high pressure wellhead housing. The port may have an external opening that is on the external surface of the high pressure wellhead housing and an internal opening that is on the internal surface of the high pressure wellhead housing. The port(s) may extend in a substantially and/or approximately radial direction through the high pressure wellhead housing. This may be along the entire length of the port(s) from the external opening to the internal opening, i.e., there may be no bends or change of direction of the fluid path through the port.

The external opening of one or more or each port may be at the same axial height as the internal opening of the respective port.

The port(s) may extend through the wall in a manner that can be formed by direct machining from the external surface to the internal surface of the high pressure wellhead housing.

For example, the port(s) may extend straight through the wall of the high pressure wellhead housing. This may be in a direction that is parallel to the radial direction of the high pressure wellhead housing. This may allow the port(s) to be formed more easily. For example, the ports may be machined in a single operation through the wall of the high pressure wellhead housing.

One or more, or each port may be reinforced. One or more, or each port may comprise an aperture through the high pressure wellhead housing.

Each port may be used to monitor and/or control one or more of the pressure, temperature or fluid properties within the respective annulus. Thus the method may comprise monitoring and/or controlling one or more of the pressure, temperature or fluid properties within one or more or each annulus.

The subsea wellhead assembly may comprise one or more sensors. The sensors may be for monitoring fluid within an annulus of the assembly. Thus, the port together with the sensor(s) may be used to monitor a fluid within an annulus of the subsea well assembly. The sensors may comprise a pressure sensor, a temperature sensor and/or a fluid sensor. The fluid sensor may be for sensing fluid properties, such as whether the fluid is a gas or liquid, the composition of the fluid and/or the viscosity of the fluid.

Each port may be connected (e.g., fluidly connected) to a respective sensor or sensor set.

The assembly may be arranged to permit fluid flow through the port (e.g., into or out of the annulus). The method may comprise effecting fluid flow through the port, such as injecting a fluid into the annulus or bleeding fluid from the annulus. This may be performed based on the result of monitoring the fluid in the annulus. Removing fluid from the annulus, i.e., bleeding a fluid through the port, may allow the pressure in the annulus to be reduced.

The method may comprise monitoring the fluid in the annulus, and then controlling the fluid in the annulus based on the monitoring.

The method may, for example, comprise detecting a high pressure in the annulus and then bleeding fluid through the annulus to reduce the pressure. The port may be fluidly connected to sensors, valves (e.g., one way valves and/or check valves) and/or storage tanks. This may permit further handling (e.g., monitoring and storage) of a fluid once it is bled from an annulus.

Fluid bled from the port may be bled into the sea, routed back to pressure equipment (such as a blowout preventer (BOP) or Christmas tree) on the wellhead and/or to a storage tank such as in a remotely operated vehicle (ROV), docking station or a surface vessel.

One or more, or each port may be connected (e.g., fluidly connected) to tubing. The tubing may be routed up to a convenient location to permit monitoring and/or controlling of the fluid from the annulus to which the respective port is connected.

One or more, or each port may be associated with an isolation device, such as a valve. This may allow the access to the annulus to be controlled, such as opened and closed.

If annulus monitoring and/or controlling is not required for a particular annulus, the associated port may be omitted or blanked off.

One or more, or each port may be arranged to permit injection of a fluid into its respective annulus. Thus, the method may comprise injecting a fluid into the annulus through the port. The method may comprise monitoring a fluid in the annulus and based on the result of the monitoring (e.g., if the pressure is too low) injecting a fluid into the annulus.

The injected fluid may be one or more of water, a corrosion inhibitor, a hydrate inhibitor, anti-leaking material (e.g., sealant), etc.

Fluid may be injected to solve problems. For example, the fluid may help detect or fix a leak, prevent or dissolve hydrates, inhibit or stop corrosion, increase the pressure, reduce the viscosity, etc.

The ports may be formed in the high pressure wellhead housing prior to installation. Therefore, the high pressure wellhead housing may be installed with the ports therein. The associated tubing, sensors and/or isolation devices (if present) may be installed after the high pressure wellhead housing is installed or they may be preinstalled on the high pressure wellhead housing and thus installed together with the high pressure wellhead housing.

When installed, optionally there may be no components that entirely circumferentially encompass the wellhead at the axial position of the ports, i.e., at the axial position of the external opening(s) and/or interior opening(s). This may mean that the location of the ports, i.e., at the axial position of the external openings and/or interior openings, is not covered by another component in a direction radially outward of the high pressure wellhead housing. There may be a wellhead support component, such as a conductor housing, around the high pressure wellhead housing. However, at the location of the port(s) there may be a space, such as an axial groove, between the high pressure wellhead and the wellhead support component. This space may for example accommodate line(s) that extend to/from the port(s). With this arrangement, the port is located at a circumferential location where the high pressure wellhead housing is not covered by the wellhead support but the high pressure wellhead housing can still be supported.

Whilst there may be components radially outward of the high pressure wellhead housing (e.g., a wellhead support that provides lateral support to the wellhead) at the same axial height (i.e., elevation) as one or more of the ports, these components may be at one or more distinct circumferential positions that is/are different to the ports rather than around the entire circumference of the high pressure wellhead housing. This means that the ports may be located at a circumferential location between the components (such as a wellhead support) radially outward of the high pressure wellhead housing.

It may be necessary for the high pressure wellhead housing to be laterally supported. This is because the high pressure wellhead may be subject to horizontal forces and/or bending moments from components that are connected to the top of the high pressure wellhead housing such as a well control equipment such as a BOP. In order to ensure that the wellhead housing is sufficiently supported, it may be necessary and/or desirable to have lateral support at the same axial height as the location of one or more or all of the ports.

Thus, the assembly may comprise a wellhead support for laterally supporting the high pressure wellhead housing, wherein at the axial height of one or more or all of the ports (i.e., the internal and/or external opening) the wellhead support surrounds the high pressure wellhead housing at circumferentially discrete locations and the one or more or all of the ports are located at a circumferential location where the high pressure wellhead housing is not covered by the wellhead support.

For example, the wellhead support may comprise a plurality of radially extending beams. The wellhead support, e.g., beams, may be arranged to provide lateral support whilst leaving some parts of the high pressure wellhead housing exposed.

The one or more or all of the ports may be located between two radially extending beams.

The wellhead support, e.g., radially extending beams, may be part of a wellhead foundation. The wellhead support may be fixed to the sea bed. For example, the foundation may comprise a suction anchor that comprises the wellhead support, e.g., beams. The wellhead support may be the top part of the suction anchor. The suction anchor may be sucked into the sea floor so as to fix the wellhead support to the seabed and provide a load path from the wellhead to the sea floor.

The foundation may be additionally or alternatively fixed to the sea floor by being cemented to the sea floor and/or by piles, etc.

The location of the ports may be exposed to the outside environment.

At least part of the circumference of the high pressure wellhead housing at the axial location of the one or more annulus optionally may not be covered.

This may make it more convenient and/or easier to have ports through the wall of the high pressure wellhead housing.

The wellhead assembly optionally may not comprise a low pressure conductor housing around the high pressure wellhead housing.

A typical (prior art) well assembly will comprise a low pressure wellhead housing (i.e., a conductor housing). The low pressure housing (i.e., the conductor housing) is a well-known structural component that provides reinforcement of the wellbore and/or a conduit for casing. This is a tubular component in which the high pressure wellhead housing is normally installed.

It has recently been realized that the function of this well-known component can be achieved by other components in the assembly and thus it is not essential for the high pressure wellhead housing to be located within a low pressure well head housing.

For example, for a subsea wellhead assembly with a suction anchor foundation, the suction anchor (e.g., the outer suction skirt) may provide the functions usually achieved using a low pressure wellhead housing. Thus, the usual low pressure conductor may not be essential in a well with a suction anchor foundation, i.e., the presence of the low pressure conductor is optional.

The well assembly may comprise a suction anchor that acts as a foundation for the well. The well assembly optionally may not comprise a conductor.

The axial location of the port(s), e.g., the axial position of the external opening(s) and/or interior opening(s), and/or the annuli being monitored may be above the top of the suction anchor.

The foundation (i.e., upper surface of the foundation) of the well assembly (e.g., a suction anchor) may be located axially below the one or more annuli being monitored and/or controlled, and/or below the one or more ports. Alternatively, at the axial height (i.e., elevation) of the port(s), e.g., at the axial position of the external opening and/or interior opening, the foundation may surround the high pressure wellhead housing at circumferentially discrete locations and the port(s) may be located at a circumferential location where the high pressure wellhead housing is not covered by the foundation. This may prevent the foundation obstructing the one or more ports.

In an embodiment, the subsea well assembly may comprise: a high pressure wellhead housing; and a plurality of ports, wherein the ports each extend through the wall of the high pressure wellhead housing and are each for monitoring and/or controlling fluid within an annulus of the high pressure wellhead housing, wherein the subsea well assembly may not comprise a low pressure conductor housing around the high pressure wellhead housing.

The wellhead assembly may comprise a series of stacked casing hangers inside the high pressure wellhead housing. Each casing hanger may support a different nominal diameter casing section/pipe. The casing hangers may be attached (e.g., sealed and/or locked) to the high pressure wellhead housing and the annulus created between two subsequent casing sections may be sealed off inside the wellhead by means of a pack-off element/assembly which, in addition to sealing the annulus, may also attach the casing hanger to the high pressure wellhead housing.

The well assembly may be a subsea oil and gas well assembly. For example, the well assembly may be a production well, an exploration well and/or injection well, for example.

In a broadest aspect, the present invention may provide a subsea well assembly, the assembly comprising: a high pressure wellhead housing; and a port (e.g., monitoring port), wherein the port extends through (e.g., through the wall of) the high pressure wellhead housing and is for monitoring and/or controlling a fluid within an annulus within the high pressure wellhead housing. The subsea well assembly and a method of controlling an annulus of the high pressure wellhead housing of a subsea well assembly may comprise one or more or all of the above described features.

BRIEF DESCRIPTION OF THE DRAWINGS

Certain preferred embodiments of the present invention will now be described by way of example only with reference to the accompanying drawings, in which:

FIG. 1 is a schematic of a subsea wellhead assembly comprising ports.

DETAILED DESCRIPTION OF THE INVENTION

FIG. 1 shows a schematic of a subsea wellhead assembly 1 that comprises a high pressure well head housing 2.

Within the high pressure wellhead housing 2 are a plurality (in this case, three) intermediate casing hangers 4.

Each intermediate casing hanger is sealed to the high pressure wellhead housing 2 by a pack-off assembly 6. Each casing hanger 4 suspends a casing.

The lowermost intermediate casing hanger 4 (i.e., the intermediate casing hanger closest to the reservoir) is supported on a lower landing device 8. The lower landing device 8 is located on, fixed to, integrated with, part of, located in, etc., the high pressure wellhead housing 2.

The intermediate casing hangers 4 are stacked and supported on each other on top of the lowermost intermediate casing hanger 4 that is supported on the lower landing device 8.

The wellhead assembly 1 also comprises a production casing hanger 12 within the high pressure wellhead housing 2. The production casing hanger 12 is sealed and locked to the high pressure wellhead housing 2 by a production casing pack-off assembly 14.

The production casing hanger 12 is supported and held in place on an upper landing device 16. This is arrangement leaves a gap/annulus 20 below the production casing hanger 12 into which the lower casing hangers 4 may move to accommodate well growth. Despite the ports 28 being shown with this arrangement that is arranged to accommodate well growth, the ports can equally be used in a more conventional arrangement in which the production casing hanger 12 is landed onto the upper most casing hanger 4.

Between the production casing hanger 12 and the uppermost intermediate casing hanger 4, between each of the intermediate casing hangers 4 and underneath the lowermost casing hanger 4 are annuli 20, 22, 24 and 26. Each annulus 20, 22, 24 and 26 is in normal operation isolated from the other annuli and each annulus contains a fluid.

The assembly comprises a plurality of ports 28. These ports 28 extend through the high pressure well head housing 2 to a respective annulus 20, 22, 24 and 26. The ports 28 are apertures that extend straight through the wall of the high pressure wellhead housing 2 and they extend in a substantially radial direction (with reference to the high pressure wellhead housing).

The ports 28 allow monitoring and/or controlling of the fluid in each of the annuli 20, 22, 24 and 26.

One or more of the pressure, temperature and/or fluid characteristics of the fluids in the annuli 20, 22, 24 and 26 may be monitored and/or controlled.

The assembly may comprise tubing 30 that is fluidly connected to the ports 28. Each port 28 may be connected to a separate line of tubing 30.

Each line may comprise an isolation device 32, such as a valve. This may allow the access to the annulus via the port 28 to be controlled, such as opened and closed.

Each port 28 may be fluidly connected to one or more sensors. The sensors may comprise a pressure sensor, a temperature sensor and/or a fluid sensor. The fluid sensor may be for sensing fluid properties, such as whether the fluid is a gas or liquid, the composition of the fluid and/or the viscosity of the fluid.

A separate sensor may be provided on each line.

Based on the output of the sensors, fluid may be injected into or bled from one or more of the ports 28.

As shown in FIG. 1, the assembly 1 optionally may not comprise a low pressure wellhead housing around the high pressure wellhead housing 2.

At the circumferential location of the ports 28, there may be no components covering the high pressure wellhead housing 2.

The high pressure wellhead housing 2 is supported by a well support 34. However, this is in contact with the high pressure wellhead housing 2 at circumferential locations that are offset from the circumferential locations of the ports 28. Additionally, the well support 34 may be located axially below the location of the ports 28. This is so that the ports 28 can extend through the high pressure wellhead housing 28 and not be blocked on a radially outer surface by another component.

The invention claimed is:

1. A subsea well assembly comprising:

a high pressure wellhead housing;

a port for monitoring and/or controlling fluid within an annulus within the high pressure wellhead housing, wherein the port extends through the high pressure wellhead housing; and a wellhead support for laterally supporting the high pressure wellhead housing, wherein:

the wellhead support is a part of a wellhead foundation;

at an axial height of the port, the wellhead support surrounds the high pressure wellhead housing at circumferentially discrete locations that are different from a circumferential location of the port; and the circumferential location of the port is a circumferential location where the high pressure wellhead housing is not covered by the wellhead support.

2. The subsea well assembly according to claim 1, wherein the subsea well assembly does not comprise a low pressure conductor housing around the high pressure wellhead housing.

3. The subsea well assembly according to claim 1, wherein the port extends straight from an external surface of the high pressure wellhead housing to an internal surface of the high pressure wellhead housing.

4. The subsea well assembly according to claim 1, wherein the port is for monitoring and/or controlling pressure within the annulus.

5. The subsea well assembly according to claim 1, wherein the port is for monitoring and/or controlling temperature and/or fluid properties within the annulus.

6. The subsea well assembly according to claim 1, wherein the port is for injecting fluid.

7. The subsea well assembly according to claim 1, further comprising one or more sensors for monitoring fluid within the annulus.

8. The subsea well assembly according to claim 1, wherein the port is fluidly connected to an isolation device.

9. The subsea well assembly according to claim 1, wherein at the circumferential location of the port there are no components covering the high pressure wellhead housing.

10. The subsea well assembly according to claim 1, wherein the wellhead foundation comprises a suction anchor.

11. The subsea well assembly according to claim 1, wherein:

the annulus is one of a plurality of annuli; and the port is one of a plurality of ports for monitoring or controlling fluid within the plurality of annuli, respectively.

12. A method of monitoring and/or controlling fluid within an annulus of a high pressure wellhead housing of a subsea well assembly, the method comprising:

providing the subsea well assembly of claim 1; and monitoring and/or controlling fluid within the annulus of the high pressure wellhead housing.

13. The method according to claim 12, further comprising monitoring temperature and/or fluid properties within the annulus.

14. The method according to claim 12, further comprising injecting fluid into the annulus.

15. The subsea well assembly according to claim 8, wherein the isolation device is a valve.

* * * * *